United States Patent [19]

Dunne et al.

[11] Patent Number: 5,074,216

[45] Date of Patent: Dec. 24, 1991

[54] INFRARED SIGNATURE ENHANCEMENT DECOY

[75] Inventors: Anthony L. Dunne, Hudson; Joseph C. Huber, Jr., Cuyahoga Falls, both of Ohio

[73] Assignee: Loral Corporation, New York, N.Y.

[21] Appl. No.: 92,859

[22] Filed: Sep. 3, 1987

[51] Int. Cl.[5] ..... F42B 13/44

[52] U.S. Cl. ..... 102/334; 102/291

[58] Field of Search ..... 102/334, 291

[56] References Cited

U.S. PATENT DOCUMENTS 4,448,106 5/1984 Knapp ..... 89/1 A 4,498,392 2/1985 Billard et al. ..... 102/342

4,621,579 11/1986 Badura et al. ..... 102/334

4,697,521 10/1987 Espagnacq et al. ..... 102/334

4,700,628 10/1987 Varmo ..... 102/339

*Primary Examiner*—Peter A. Nelson

*Attorney, Agent, or Firm*—L. A. Germain

[57] ABSTRACT

This invention generally relates to aircraft countermeasures and more particularly to an infrared decoy flare which operates in a substantially aerodynamic configuration and effectively shields aerodynamic cooling associated with its operation when ejected into the adjacent windstream of a tactical aircraft. The decoy provides an enhanced infrared signature to IR and heat-seeking threats to effectively decoy them away from the protected aircraft.

10 Claims, 4 Drawing Sheets

FIG.-3
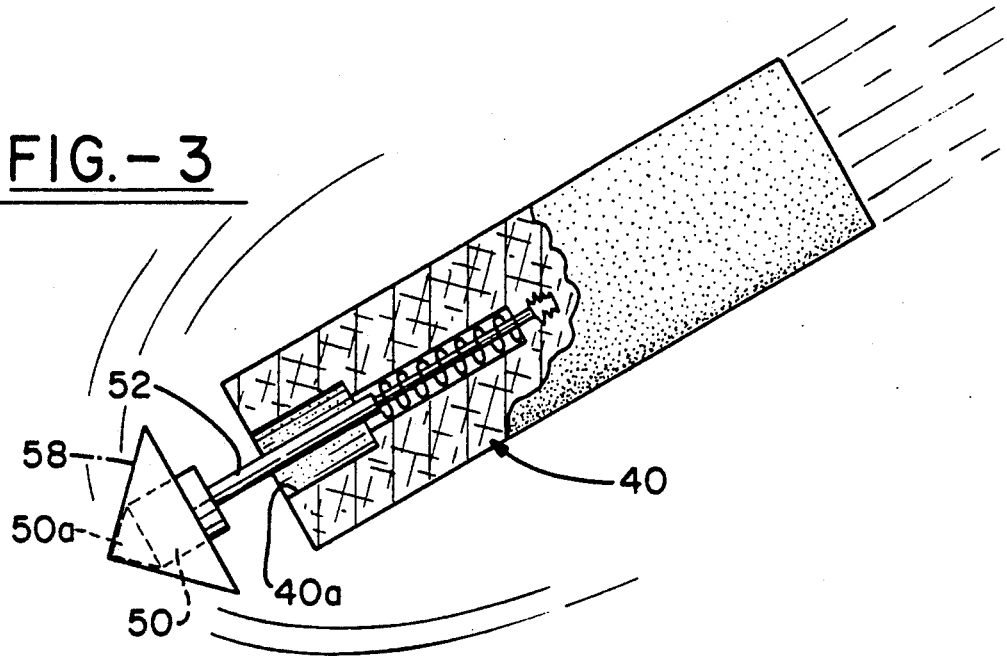
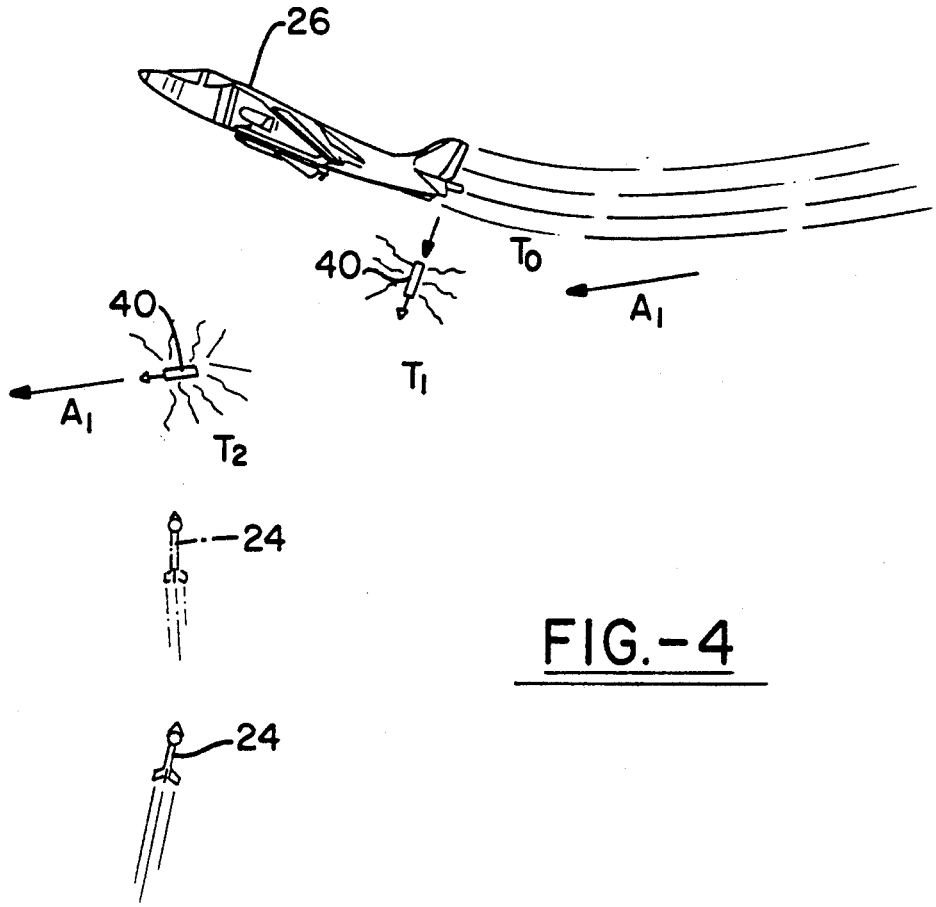
FIG.-4

INFRARED SIGNATURE ENHANCEMENT DECOY

BACKGROUND OF THE INVENTION

This invention generally relates to aircraft countermeasures and more particularly to an infrared decoy flare which operates in a substantially aerodynamic configuration and effectively shields aerodynamic cooling associated with its operation when ejected into the adjacent windstream of a tactical aircraft. The decoy provides an enhanced infrared signature to IR and heat-seeking threats to effectively decoy them from the protected aircraft.

Infrared decoy flares are already known and used by aircraft for defense against IR and/or heat-seeking threats. The decoy flares conventionally comprise a hot-burning composite material which is compression molded and/or extruded into a desired shape. The shape generally corresponds to the shape of a storage canister or dispenser can from which the decoy is ejected by the aircraft upon command by the pilot. While any shape may be used, the composite forming the decoy body will conventionally have a circular or rectangular cross section and this for economy and ease of manufacture. Further, decoy flares of this type may be characterized by longitudinally oriented flutes or grooves formed into the outwardly-facing surface and these are for the purpose of increasing the total surface area of the composite material. The shaped composite is covered with a coating that is readily ignited when the decoy is released from the aircraft. Upon ignition, the coating explodes in a flash over the surface area and this effects ignition of the composite material which comprises the primary source of infrared radiation for flare effect.

One of the problems associated with presently used IR decoy flares is that they tend to tumble upon being ejected by the aircraft into its adjacent windstream. This tumbling increases the cooling effect because of the increased exposure of surface area to aerodynamic cooling. Of course, the cooling is accompanied by a decrease in IR signature and therefore the effectiveness of the flare as a decoy is greatly diminished.

Therefore, and in accordance with one aspect of the present invention, it is an object to provide an IR decoy flare which exhibits a reduction in aerodynamic cooling effect and thus provides an enhanced IR signature to infrared and/or heat-seeking threats to the aircraft being protected.

It is in accordance with another aspect of the invention an object to provide an aerodynamically stable decoy flare which is not subject to tumbling upon being ejected into the aircraft windstream and therefore exhibits an enhanced IR signature simulating the target aircraft for greater decoy effect.

SUMMARY OF THE INVENTION

A decoy flare, for ejection from an airborne dispenser operates in a substantially aerodynamic configuration and provides an enhanced IR signature to attract heat-seeking and IR threats for decoy affect, comprises:

a body having a length greater than its width comprised of a composite grain material capable of producing infrared radiation when ignited, the body having designated forward and aft ends and the forward end is characterized by an axial bore penetrating a specific length into the composite material;

a weighted mass affixed to the forward end of the body in a manner such that it may be stowed into the bore at the forward end and extended forwardly from the body to provide a shield and move the c.g. of the body for aerodynamic flight; and a rapidly ignitable coating covering the surface area of the composite grain material such that upon ejection of the decoy flare from the dispenser, the coating is ignited and subsequently the composite grain material is ignited for producing IR flare affect.

BRIEF DESCRIPTION OF THE DRAWINGS

The invention may best be understood by reference to the following detailed description when taken in conjunction with the accompanying drawings in the several figures in which like-reference numerals indicate like-elements and in which:

FIG. 3 illustrates a fully deployed decoy flare upon being launched from an aircraft;

FIG. 4 illustrates a decoy deployment sequence; and

DETAILED DESCRIPTION OF THE INVENTION

Figure 1:
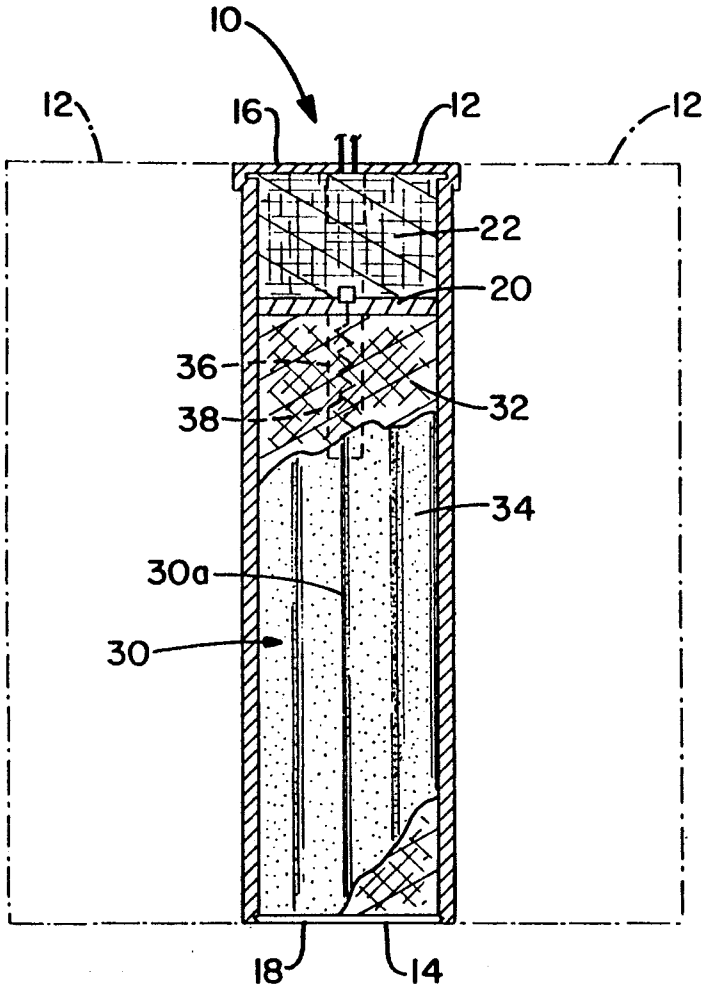
FIG. 1 is an elevational view, partially broken away and in partial cross section, illustrating a typical dispenser for launching an infrared decoy flare from a tactical aircraft, the illustration showing but one such dispenser in solid lines, the adjacent ones of a group of dispensers being shown in dot-dashed ghost lines.

Referring to the drawings, FIG. 1 illustrates a decoy dispensing apparatus generally indicated by reference numeral 10. The apparatus 10 may be in the form of a carrier pod or the like carried by an aircraft (not shown) and which includes a plurality of decoy canisters 12. The canisters 12 are generally cylindrical in shape and characterized by an open outboard-facing end 14 and a closed inboard-facing end 16. The outboard end 14 may include a closure piece 18 which functions to present a smooth outboard-facing surface to ground-based radar as well as to contain a decoy device within the canister 12 during the time of its storage and prior to being ejected from the canister 12. The closed inboard end 16 includes a piston member 20 backed by an explosive squib 22. The squib 22 is a known device that may be electronically activated by the pilot or a warning system when it is desired that a decoy be deployed from a particular canister 12.

A decoy is generally indicated by reference numeral 30 and it is packaged within the canister in any known manner. It will be appreciated from the foregoing description that, upon firing of the squib 22, the piston 20 will explosively expel the decoy 30 out of the canister 12 and into the adjacent windstream of the aircraft. Dispensers of the type described may, of course, be used for various type decoys depending upon the particular threat to the aircraft and these may include chaff and/or ignitable flare decoys for producing infrared radiation. Ignitable, infrared-producing flares are generally comprised of a hot-burning grain composition 32 such as for example, a teflon-magnesium composite which is cover-coated with a readily ignitable phosphorus 34. The decoy flare 30 may also have a plurality of longitudinal grooves 30*a* which increase the total surface area and facilitate burning for flare effect.

In operation, the phosphorus coating 34 is ignited by an ignition means 36 which may be any type of spark and/or flame-producing flint or match device 38. The spark-producing device 38 is operative at the instant of time when the decoy 30 is ejected from the canister 12. For example, the ignitor device 38 may be mounted to the piston member 20 and in a relative position to the phosphorus coating 34 such that upon ejection of the decoy and capturing of the piston 20 at the outboard end, the ignitor 38 strikes a sufficient spark and/or flame to ignite the phosphorus coating 34. As hereinbefore mentioned, the phosphorus ignites in a flash over the surface of the flare body and this results in an almost instantaneous ignition of the composite material 32 which forms the primary source of infrared radiation for flare effect.

Figure 2:
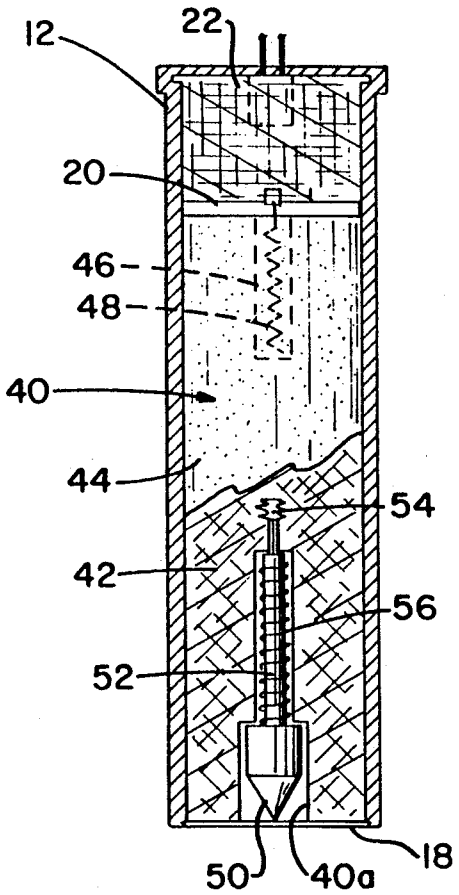
FIG. 2 is an elevational view, partially broken away and in partial cross section, of an IR decoy flare in accordance with this invention as it may be packaged into a dispenser canister of the type conventionally installed on aircraft.

Referring now to FIG. 2 of the drawings, a decoy flare in accordance with this invention is generally indicated by reference numeral 40 as it may be packaged into a canister 12 of the type described above. The decoy flare 40 comprises an ignitable, radiation-producing, grain composite 42 that is cover-coated with phosphorus 44. The flare 40 includes an ignition means generally indicated by reference number 46 which comprises an ignitor device 48 embedded in the composite material to effect firing of the phosphorus 44 in much the same manner as hereinbefore described. However, and in contrast to decoy flares of the prior art, the decoy flare 40 has a bore or recess 40*a* at the forward end which carries a nose piece mass or weight 50 within its confines during storage of the decoy. The mass 50 is connected to the flare body by way of a telescoping rod member 52 which is anchored into the composite material 42 at the inboard end of the bore 40*a*. The connection may be made by any known technique including screw threads, barbs and the like as indicated at 54. The telescoping rod 52 carries a spring 56 which abuts the nose piece 50 at one end and abuts the bottom of the bore 40*a* at its opposite end. In the normal packaged condition of the decoy flare 40 as shown in FIG. 2, the spring 56 is in a compressed state. This is accomplished by reason of the closure piece 18 at the outboard end of the canister 12 when the decoy is in the packaged condition. In this respect, it is anticipated that the closure piece 18 will be in another form to be described hereinafter, which form is carried along with the decoy flare 40 as it is expelled from the canister 12. Its purpose and function will become apparent as the description proceeds.

FIG. 3 illustrates a decoy flare 40 after it has been ejected from a dispenser canister 12. Upon ejection, the spring force moves the nose piece weight 50 out of the bore 40*a* by an extension of the telescoping rod 52. In this configuration, the c.g. of the decoy flare is moved forwardly and thus presents a Weight-forward aerodynamic shape. Furthermore and in its simplest form, the nose piece 50 has a conical forward end 50*a* which effectively directs the airflow in streamlines about the decoy body as it moves through the windstream. The airstream flow may be further enhanced by reason of a shaped forebody piece indicated at 58. The forebody piece 58 may be initially in the shape of a disk and installed as the closure piece 18 illustrated in FIG. 2 and mounted in a manner such that it will be carried along with the decoy flare 40 when it is explosively ejected from the canister 12. For example, the forebody piece 58 may be affixed to the forward end 50*a* of the weighted nose piece 50 and comprise a material which has sufficient strength to provide the closure required at the open end 14 of the canister 12 while also being deformable to a substantially conical shape upon the explosive ejection of the decoy flare 40.

FIG. 4 pictorially illustrates an aircraft launch sequence of the decoy flare 40 which is intended to attract an IR and/or heat-seeking threat 24 away from a tactical aircraft 26. Upon ejection at time $T_0$ indicated in the drawing, the aircraft velocity is in the direction of arrow $A_1$. The decoy flare 40 is transformed to its aerodynamic shape at time $T_1$ by an extension of the weighted nose piece 50. Because of its high velocity, the decoy flare 40 tends to continue in the direction of arrow $A_1$ and at time $T_2$ offers a credible false target to the threat 24. The threat 24 is therefore locked onto the decoy flare 40 and the aircraft 26 initiates an evasive maneuver. It must be appreciated that, from the time of ejection at time $T_0$ to time $T_2$, the total elapsed time is less than 5 seconds and more realistically it will be about 2 seconds. During this extremely short period of time, the decoy flare 40 must provide the requisite IR effect to attract the threat 24 and once committed, a heat-seeking missile cannot change course and pursue the aircraft. This is so because the missile has a limited field of view for locking onto the target and cannot scan the whole world around it in the period of time involved. Therefore, the decoy flare 40 has accomplished its purpose.

Figure 5A:
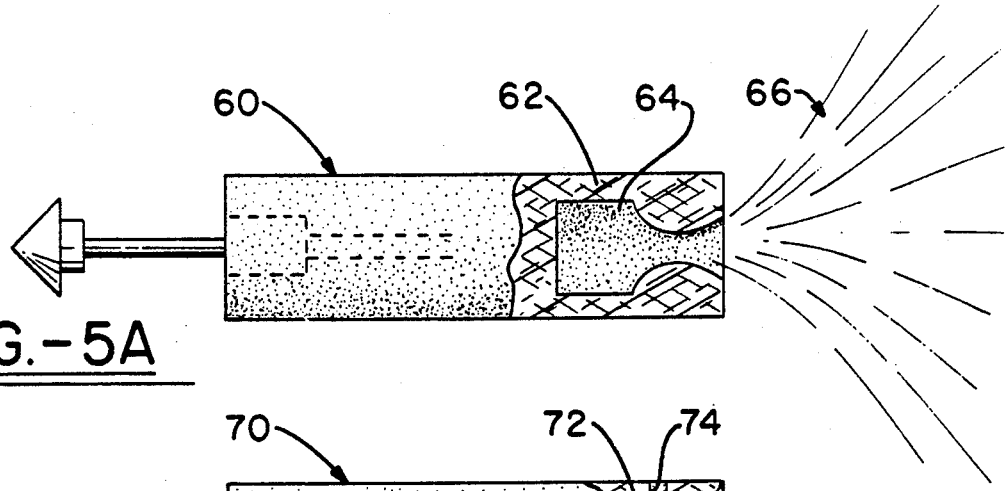
FIGS. 5A–5F illustrate various alternative configurations for the grain material which comprises the flare body to accomplish an enhanced exhaust plume of burning grain for increased IR signature and decoy effect.
Figure 5B:
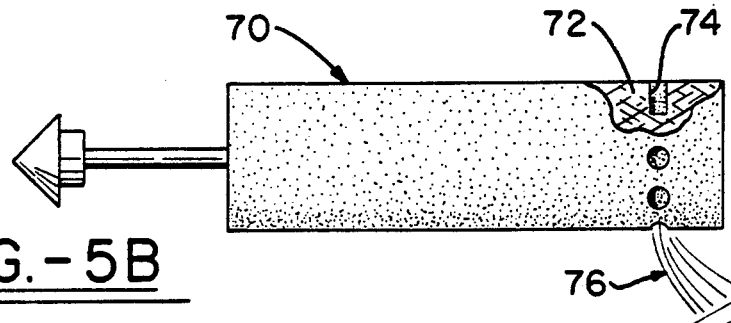
Figure 5C:
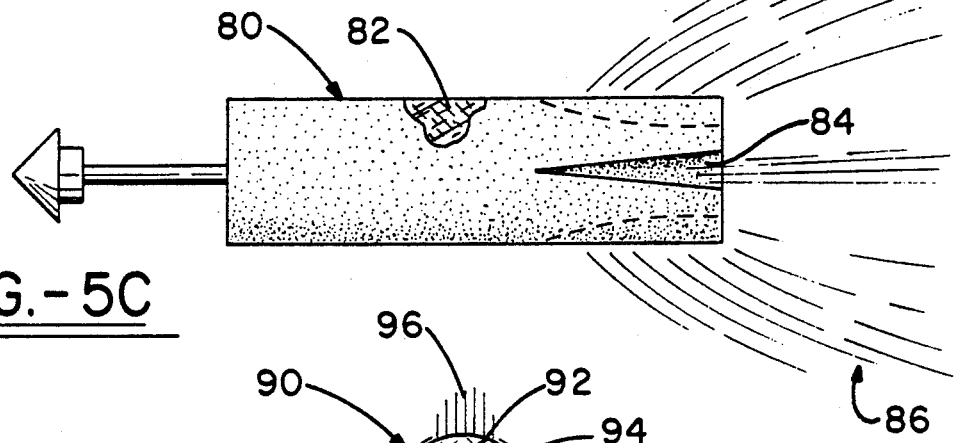
Figure 5D:
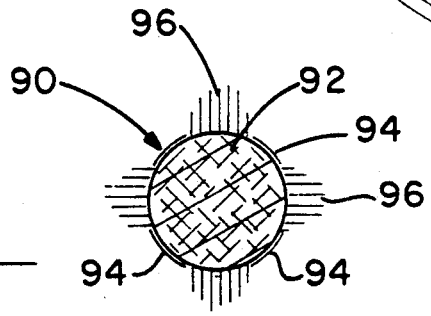

FIGS. 5A–5E illustrate various additional embodiments of the decoy flare 40 which provide flight stabilization and further enhance the IR signature for decoy affect. For example, in FIG. 5A a decoy flare 60 is illustrated and it has a chamber 64 configured into its aft end and into the composite grain material 62 which comprises the decoy body. Upon ignition of the composite 62, an expanded plume 66 is generated which flight-stabilizes the body reducing its drag and allowing it to propel forwardly and thus more closely match the speed of the aircraft while at the same time providing a greatly enhanced IR signature for decoy effect. In FIG. 5B a decoy flare 70 has a plurality of radially-oriented bores 74 configured into the composite grain material 72 which comprises the decoy body. These function to aerodynamically stablize the body while also increasing the outwardly-facing surface area and thus also the IR emitted when the composite is ignited. FIG. 5C provides the same affect by reason of a decoy flare 80 having a plurality of tapered slots 84 configured into the composite grain material 82 comprising the decoy body. Upon ignition of the composite, the slots 84 provide radially-directed gaseous plumes 86 which aerodynamically stablize the body and enhances IR output. The same affect may be accomplished as illustrated in FIG. 5D wherein an end view of a decoy flare 80 is shown having selected areas of composite grain material 92 covered with a barrier material 94. The uncovered areas will result in gaseous plumes 96 which radiate outwardly from these areas. The embodiments of FIGS. 5A–5D all resemble a body functioning with a stabilizing conically divergent afterbody and this results in an improvement in aerodynamic stability while also accomplishing an enhancement of IR output upon ignition of the composite material comprising the decoy body.

Figure 5E:
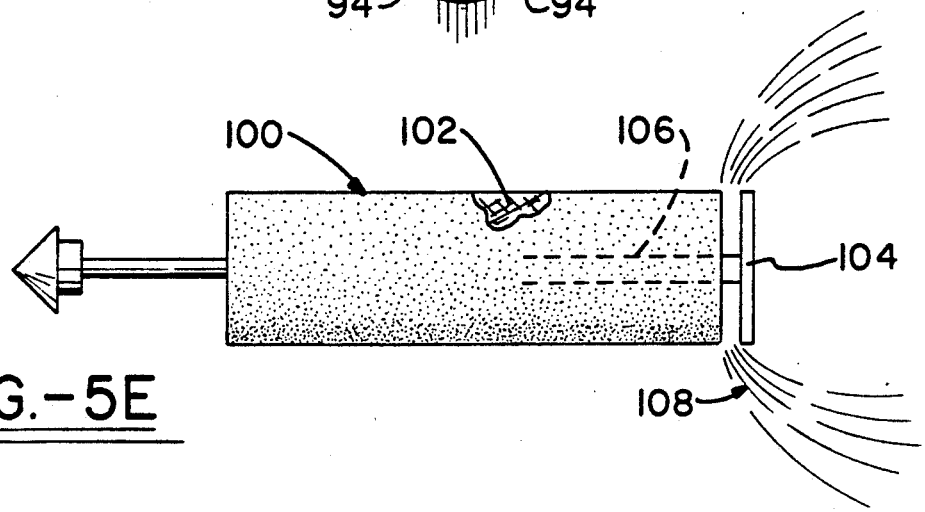

In FIG. 5E a decoy flare 100 is shown having a plate 104 mounted to the aft end of the composite grain material 102 in a spaced relationship thereto. The plate 104 may be mounted by any known means such as by insert rods and the like 106 embedded within the composite material. Upon ignition of the composite grain material 102, a flame propogation 108 is generated around the plate 104 creating an affect similar to that of a body having a stabilizing and diverging conical afterbody.

Figure 5F:
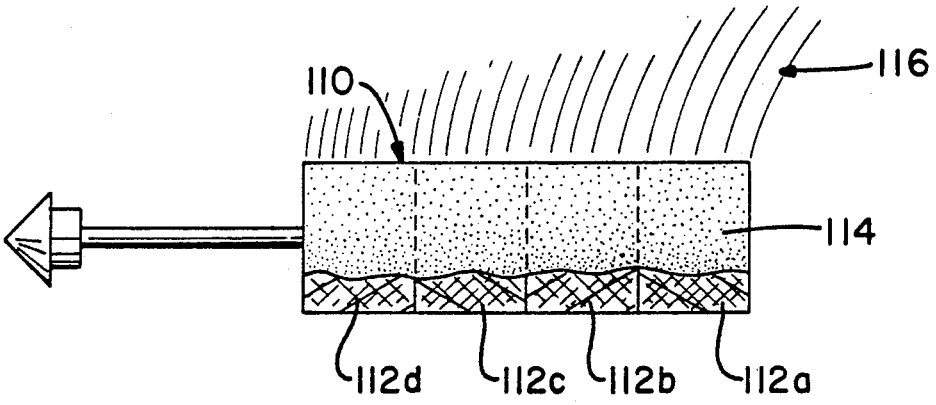

FIG. 5F illustrates a decoy flare 110 comprised of a plurality of sections of varying burn rate composite grain materials, each section 112*a*–112*d* exhibiting a burn rate slightly different from the adjacent section. For example, the composite grain material of section 112*a* burns at a faster rate than the material of section 112*b* which burns at a faster rate than material of section 112*c*, etc. In this manner, and upon ignition of the composite grain by the phosphorus coating 114, a gaseous plume 116 is generated which approximates a conically shaped after-body.

While certain embodiments of the invention have been presented and described in detail, it is to be understood that the invention is not limited thereto or thereby. For an appreciation of the true scope and breadth of the invention, reference should be made to the following claims.

What is claimed is:

1. A decoy flare ejectable from an airborne dispenser operates in a substantially aerodynamic configuration and provides an enhanced infrared signature to attract IR and heat-seeking threats for decoy effect comprising:

a body of ignitable, infrared-producing, composite grain material having a length greater than its width and designated forward and aft ends, the forward end characterized by an axial bore penetrating a specific length into the composite grain material;

a weighted mass affixed to the forward end of the body in a manner such that it may be stowed into the bore at the forward end and extended axially away from the forward end to move the c.g. of the body forwardly for aerodynamic flight and to shield the body from direct air flow about the body; and a rapidly ignitable coating covering the surface area of the composite grain material such that, upon ejection of the decoy flare from the dispenser, the coating is ignited which results in ignition of the composite grain material for producing IR effect.

2. The decoy flare as set forth in claim 1 wherein the weighted mass is affixed to the forward end of the body by a telescoping rod connected to the mass at one end and to the composite grain material within the bore at the opposite end.

3. The decoy flare as set forth in claim 2 wherein a spring is mounted about the rod, which spring is compressed by the mass when said mass is stowed within the bore at the forward end of the body and effects an extension of the telescoping rod to move the mass forwardly of the body.

4. The decoy flare as set forth in claim 1 wherein an axial bore is provided at the aft end of the body which terminates in a chamber within the composite grain material, said chamber and bore providing an exhaust plume for flight stabilization and IR enhancement when the composite material is ignited.

5. The decoy flare as set forth in claim 1 wherein a plurality of radially-oriented bores extend into the composite grain material about the circumferential extent at the aft end of the body to provide radially-extending exhaust plumes for flight stabilization and IR enhancement when the composite grain material is ignited.

6. The decoy flare as set forth in claim 1 wherein a plurality of slots extend radially into the composite grain material in spaced, longitudinally-oriented positions about the circumferential extent of the aft end of the body to provide exhaust plumes for flight stabilization and IR enhancement when the composite grain material is ignited.

7. The decoy flare as set forth in claim 1 wherein selected areas of the composite grain material are covered with an inhibitor such that the uncovered areas provide burning exhaust plumes for flight stabilization and IR enhancement when the composite grain material is ignited.

8. The decoy flare as set forth in claim 1 wherein a plate is mounted to the aft end of the body in a spaced relationship to the end such that a deflection of burning exhaust creates an aft plume for flight stabilization and IR enhancement upon ignition of the composite grain material.

9. The decoy flare as set forth in claim 1 wherein the composite grain material is varied along the length of the body in accordance with burn rates of the material, the composite grain material at the aft end of the body having a higher burn rate than composite grain material at the forward end.

10. The decoy flare as set forth in claim 1 further comprising a conically-shaped forebody piece affixed to the weighted mass to increase radial airflow deflection about the body.

* * * * *